United States Patent [19]

Colick

[11] Patent Number: 5,049,212

[45] Date of Patent: Sep. 17, 1991

[54] HIGH ENERGY EXPLOSIVE YIELD ENHANCER USING MICROENCAPSULATION

[75] Inventor: Joseph F. Colick, Clinton, Md.

[73] Assignee: The United States of America as represented by the Secretary of the Navy, Washington, D.C.

[21] Appl. No.: 676,772

[22] Filed: Mar. 27, 1991

[51] Int. Cl.[5] ..... C06B 45/18

[52] U.S. Cl. ..... 149/3; 149/5; 149/14; 149/15

[58] Field of Search ..... 149/3, 5, 14, 15

[56] References Cited

U.S. PATENT DOCUMENTS

| | | | |
|---|---|---|---|
| 3,287,189 | 11/1966 | Wilson et al. | 149/8 |
| 3,767,488 | 10/1973 | Seals | 149/7 |
| 3,837,937 | 9/1974 | Fox et al. | 149/4 |
| 3,891,482 | 6/1975 | Brown et al. . | |
| 4,405,534 | 9/1983 | Deisenroth | 264/3 C |
| 4,430,132 | 2/1984 | Painter | 149/109.6 |
| 4,758,289 | 7/1988 | Sudweeks | 149/8 |

*Primary Examiner*—Stephen J. Lechert, Jr.

*Attorney, Agent, or Firm*—John D. Lewis; Kenneth E. Walden

[57] ABSTRACT

The invention consists of a class of high energy explosive yield enhancers created through the use of microencapsulation techniques. The microcapsules consist of combinations of highly reactive oxidizers that are encapsulated in either passivated inorganic fuels or inert materials and inorganic fuels. Depending on the application, the availability of the various oxidizers and fuels within the microcapsules can be customized to increase the explosive yield or modify other characteristics of high explosives. The microcapsules prevent premature reaction of the component oxidizers and inorganic fuel to allow their use in munitions and propellant applications. The physical stability of the microcapsules, in combination with epoxies, plastics, and composites, also permits microcapsules to be included in warhead structural components.

16 Claims, 1 Drawing Sheet

HIGH ENERGY EXPLOSIVE YIELD ENHANCER USING MICROENCAPSULATION

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The present invention generally relates to high energy explosives and, more particularly, to increasing the yield of such explosives through the use of microencapsulated oxidizers.

BACKGROUND OF THE INVENTION

Current organic (CHNO) explosives have energy liberation limitations based on the heats of combustion and heats of detonation of the constituent materials. In contrast, inorganic fuels can have total energy liberation values more than four times that of their organic counterparts. However, despite the higher energy liberation values, the rate of energy release for inorganic fuels is much slower than that found in organic explosives. Thus, inorganic materials, while desirable for their energy liberation characteristics, have proven to be less suitable in munitions and propellant applications.

While it is known that the use of highly reactive oxidizers can dramatically increase the energy release rate of inorganic fuels, the oxidizers also introduce additional complications. The handling, containment, safety, and stability concerns associated with such highly reactive oxidizers severely limit their use in munitions and propellant applications.

SUMMARY OF THE INVENTION

Accordingly, it is an object of the present invention to eliminate the handling, containment, safety and stability concerns associated with the use of both inorganic fuels and highly reactive oxidizers in munitions and propellant applications.

It is a further object of the present invention to enhance the rate of energy release yield of inorganic materials to approximate an explosion, either singly or in combination with organic explosives, for munitions and propellant applications.

Other objects and advantages of the present invention will become more apparent hereinafter in the specification and the drawings.

In accordance with the present invention, a class of discrete microcapsule particles has been designed to enhance the explosive yield of both inorganic and organic explosives. These microcapsule particles contain highly reactive oxidizers, either singly or in combination with organic fuels, that are enclosed by passivated inorganic fuels or inorganic fuels coated with inert substances. This design reduces the handling, containment, safety and stability concerns associated with these oxidizers, making their use as high energy explosive yield enhancers practical and desirable.

DESCRIPTION OF THE PREFERRED EMBODIMENT

Figure 1:
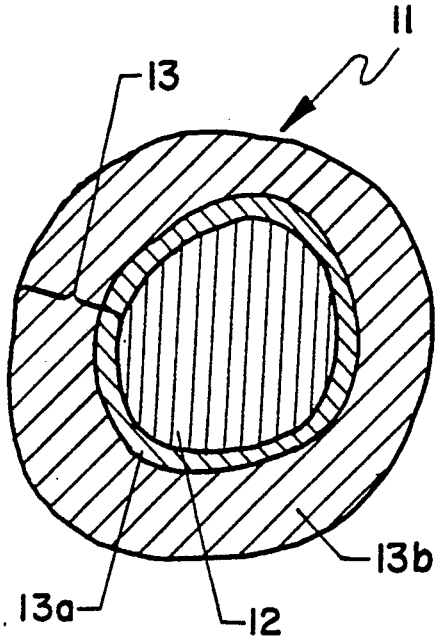
FIG. 1 is a cross-sectional view of a simple form of the microencapsulated yield enhancer according to the present invention, showing an oxidizer encapsulated in a passivated inorganic fuel.

Referring now to the drawings, and in particular to FIG. 1, a cross-sectional view of the basic form of the microencapsulated yield enhancer according to the present invention is shown and designated generally by reference numeral 11. Microcapsule 11 consists of a highly reactive oxidizer 12 that is completely encapsulated by a passivated inorganic fuel 13. Passivated inorganic fuel 13 may be a mixture, element, or compound and includes a passivated layer 13*a* separating a base inorganic fuel 13*b* from oxidizer 12. Highly reactive oxidizer 12 is generally selected from the group consisting of halogens, halides, interhalogens and their related compounds and may be solids, liquids, or gases. Interhalogens are compounds composed of two halogens while halides are compounds formed with one halogen. The compounds can be metallic or non-metallic. However, the non-metallics are generally chosen because of their reactive nature.

Passivation is accomplished by exposing the base inorganic fuel 13*b* to the reactive oxidizer for a short time and then removing the fuel. A resulting oxide layer (designated as passivated layer 13*a*), and possibly a compound made up of the oxidizer and inorganic fuel, is formed on the exposed surface of the base inorganic fuel. The passivated layer 13*a* is part of the inorganic fuel, but is composed of a different compound. For instance, if the base inorganic fuel 13*b* were an element such as aluminum, the passivated layer 13*a* would be a compound such as aluminum oxide.

Base inorganic fuel 13*b* is chosen based upon its ability to be passivated with respect to oxidizer 12. For example, if oxidizer 12 were chosen to be a halide such as sulphur hexafluoride or an interhalogen, base inorganic fuel 13*b* might be aluminum with a passivated layer 13*a* of aluminum oxide. However, it is to be understood that many other oxidizer/inorganic fuel scenarios are possible depending upon design constraints. It is only necessary that the oxidizer 12 and passivated inorganic fuel 13: 1) remain in a non-reactive state whenever microcapsule 11 is experiencing non-explosive construction, handling, storage, etc., conditions and 2) enter the reactive state only upon undergoing a threshold level of stress indicative of target impact or explosive combustion. Accordingly, once a reaction begins, the inorganic fuel is completely and efficiently combusted.

By making the "shell" of microcapsule of a passivated inorganic fuel 13 and filling it with the highly reactive oxidizer 12, a safe, handleable, non-reacting microcapsule is formed. Once the threshold level of stress has been achieved, microcapsule 11 is crushed, thereby breaking the passivated layer 13*a* of passivated inorganic fuel 13. At this point, the oxidizer is free to react with the base inorganic fuel 13*b*. The resulting high temperature will also cause the passivated layer 13*a* to react.

The microcapsules described above, as well as apparent variations of the described configurations, can be used to enhance the explosive yield or modify other explosive characteristics of a warhead in a variety of ways. Microcapsules, when mixed with a standard explosive, can enhance free air or confined blast performance. The small size of the microcapsules, typically 1–6 microns, increases the reaction area and simultaneously decreases the mass transfer limitations thereby permitting dramatic increases in the rate of energy release yield. In the absence of very severe stresses (such as target impact or explosive combustion), the microcapsules maintain the separation of the reaction components.

The microscopic separation and physical stability present in the microcapsules, maintained indefinitely under storage and handling conditions, allows production of enhanced yield warheads which are insensitive to fragment impact, cook-off, and sympathetic detonation. The present invention, by maintaining these characteristics, increases performance without sacrificing safety and permits production of enhanced explosives and warheads that can still be classified as insensitive munitions (IM). Through the selection of microcapsule sizing, geometry, composition, and mixture, this invention provides a means to customize the explosive performance. Proper combinations can provide fuel rich, perfectly stoichiometric, or oxidizer rich mixtures, depending on the particular design requirements.

The microcapsules described above, as well as apparent variations of the described configurations, can be used in a dry flowable state or combined in a matrix (such as an epoxy, plastic or other composite). When combined in a matrix, the microcapsules can be part of the fill or can also be a structural component of the warhead. Alternatively, the microcapsules can be used to enhance the fragmentation characteristics of a warhead. Hollow fragments filled with an appropriate form of microcapsules, subjected to the shock and heating of target impact, can increase the degree of fragmentation or reaction with the target material.

The microcapsule of the present invention would also find extensive utility in the field of rocket motor propellants. The microcapsules would permit the use of liquid propellants not currently utilized because of safety concerns. Also, by varying the thickness of the inorganic fuel "shell", the burning rate of the propellants can be controlled.

Figure 2:
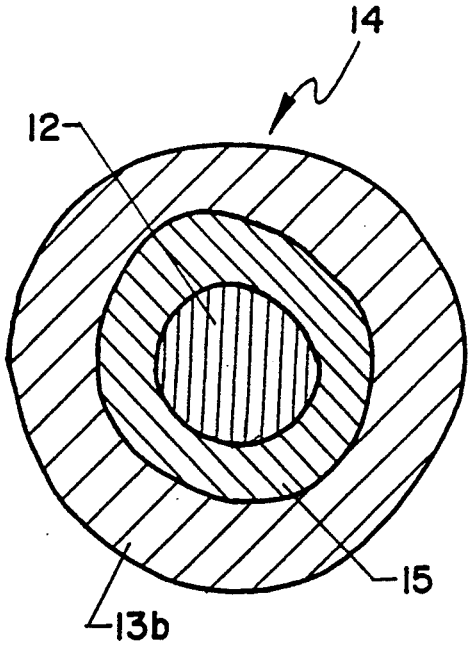
FIG. 2 is a cross-sectional view of a variation of the microencapsulated yield enhancer in FIG. 1 with both an oxidizer and an organic fuel encapsulated in a base inorganic fuel.

The present invention also provides the opportunity to use an organic fuel in conjunction with the embodiment described above. FIG. 2 is a cross-sectional view of a variation of the microencapsulated yield enhancer shown in FIG. 1. Microcapsule 14 consists of an organic fuel 15—in either gaseous, liquid, or solid state—and a highly reactive oxidizer 12 that are both encapsulated by a base inorganic fuel 13*b*. For example, the base inorganic fuel 13*b* might be magnesium, oxidizer 12 might be an interhalogen and organic fuel 15 might be acetylene. In such a case, the hot reaction between magnesium and an interhalogen will cause the acetylene which is unstable under high pressure to liberate more energy than if burned in air where complete combustion is never achieved due to the formation of carbon compounds. The mechanism by which the additional energy is gained is a result of complex interactions that are temperature and pressure dependent. The acetylene series of hydrocarbons are highly unsaturated which means that they are highly reactive. This series readily adds molecules during reactions. For example, acetylene may combine with fluorine forming acetylene fluoride. Acetylene fluoride so formed may thereafter decompose forming a mixture of acetylene fluoride, water, carbon monoxide and carbon dioxide.

By containing the organic fuel 15 within microcapsule 14, the fuel can be safely used in liquid, gaseous, or solid state. Furthermore, a stoichiometric mixture is achieved with only one microcapsule. This eliminates any potential mixing problems that could result if the components needed to be separated. Should an added measure of safety be desired, oxidizer 12 may be encapsulated within an inert shell (not shown) prior to encapsulation by organic fuel 15.

Figure 3:
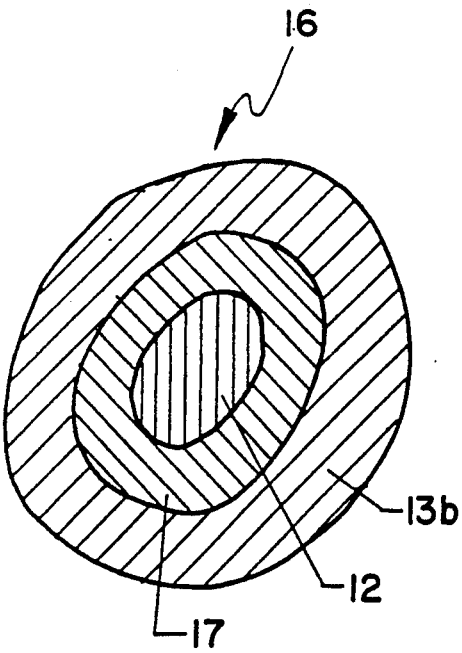
FIG. 3 is a cross-sectional view of a variation of the microencapsulated yield enhancer in FIG. 1 with the oxidizer encapsulated in an inert material, which, in turn, is encapsulated by a base inorganic fuel.

Realizing that not all inorganic fuels may be passivated with respect to the highly reactive oxidizer of choice, the advantages of the present invention may be achieved in another embodiment shown in FIG. 3. FIG. 3 is a cross-sectional view of a variation of the microencapsulated yield enhancer shown in FIG. 1 Microcapsule 16 consists of a highly reactive oxidizer 12 that is encapsulated by an inert material 17. The highly reactive oxidizer 12 and the inert material 17 are encapsulated by a base inorganic fuel 13*b*. Inert material 17 is typically a material, such as a polymer, that is inert with respect to the oxidizer 12 of choice. One example of such an inert material 17 is TEFLON TM. The advantage of TEFLON TM is that it becomes reactive at very high temperatures and, therefore, would add energy to the reaction. In this embodiment greater flexibility is possible when choosing base inorganic fuel 13*b* since it need not be passivated with respect to oxidizer 12.

Figure 4:
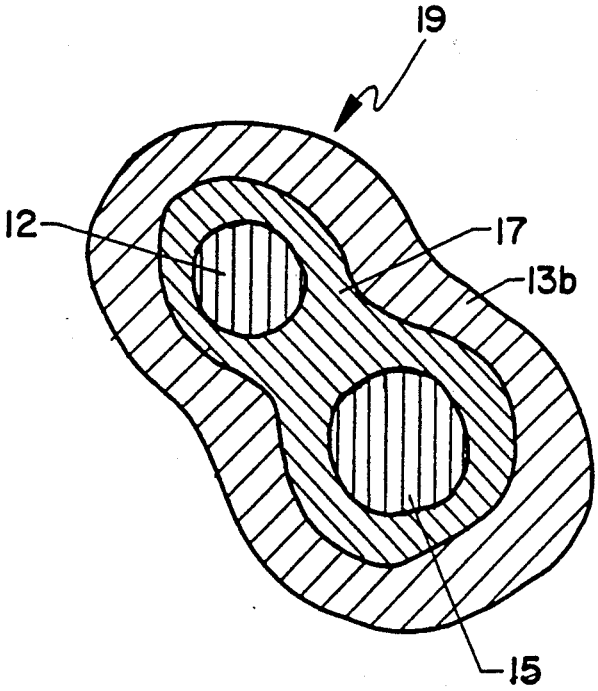
FIG. 4 is a cross-sectional view of a variation of the microencapsulated yield enhancer in FIG. 2 in which both an oxidizer and an organic fuel are encapsulated and separated by an inert material, which, in turn, is encapsulated by a base inorganic fuel.

Finally, FIG. 4 is a cross-sectional view of a variation of the microencapsulated yield enhancer shown in FIG. 2. Microcapsule 19 consists of an organic fuel 15, in either gaseous, liquid, or solid state, and a highly reactive oxidizer 12 that are encapsulated and separated by an inert material 17. The organic fuel 15, the highly reactive oxidizer 12, and the inert material 17 are encapsulated by a base inorganic fuel 13*b*. Thus, this embodiment incorporates the advantages inherent to the embodiments of FIGS. 2 and 3, namely, the additional heat of reaction generated by organic fuel 15 with a greater flexibility of choice of base inorganic fuel 13*b*.

Thus, although the invention has been described relative to a specific embodiment thereof, and several specific variations thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A high-energy, explosive yield enhancer in the form of separate, discrete microcapsule particles comprising an oxidizer selected from the group consisting of halogens, interhalogens and halides, said oxidizer being encapsulated within a passivated inorganic fuel wherein said passivated inorganic fuel includes an outer inorganic fuel layer an inner passivated layer whereby said inner passivated layer breaks down only upon undergoing a threshold level stress.

2. An enhancer as in claim 1 further comprising an organic fuel encapsulated within said inorganic fuel, wherein said organic fuel encapsulates said oxidizer.

3. An enhancer as in claim 2 wherein said organic fuel is in the liquid state.

4. An enhancer as in claim 2 wherein said organic fuel is in the gaseous state.

5. A high-energy, explosive yield enhancer in the form of separate, discrete microcapsule particles comprising an oxidizer selected from the group consisting of halogens, interhalogens, and halides, said oxidizer being encapsulated within a material that is inert under non-explosive conditions with respect to said oxidizer, said inert material being encapsulated within an inorganic fuel.

6. A high-energy, explosive yield enhancer as in claim 5 wherein said oxidizer is in the liquid state.

7. A high-energy, explosive yield enhancer as in claim 5 wherein said oxidizer is in the gaseous state.

8. A high-energy, explosive yield enhancer as in claim 5 wherein said oxidizer is in the solid state.

9. An enhancer as in claim 5 further comprising an organic fuel encapsulated within said inert material wherein said organic fuel encapsulates said oxidizer.

10. An enhancer as in claim 9 wherein said organic fuel is in a liquid state.

11. An enhancer as in claim 9 wherein said organic fuel is in a solid state.

12. An enhancer as in claim 9 wherein said organic fuel is in a gaseous state.

13. An enhancer as in claim 5 further comprising an organic fuel encapsulated within said inert material wherein said organic fuel is separated from said oxidizer by said inert material.

14. An enhancer as in claim 13 wherein said organic fuel is in a liquid state.

15. An enhancer as in claim 13 wherein said organic fuel is in a gaseous state.

16. An enhancer as in claim 13 wherein said organic fuel is in a solid state.

* * * * *